US007226495B1

(12) United States Patent
Mourão et al.

(10) Patent No.: US 7,226,495 B1
(45) Date of Patent: Jun. 5, 2007

(54) METHOD TO INCREASE THE ADHERENCE OF COATING MATERIALS ON FERROUS MATERIALS

(75) Inventors: Josè Murilo Mourão, Minas Gerais (BR); Camilo Carlos Da Silva, Espirito Santo (BR); Roberto Lùcio Nunes De Carvalho, Espirito Santo (BR); Washington Luiz Mafra, Espirito Santo (BR)

(73) Assignee: Companhia Vale Do Rio Doce, Santa Luzia-Minas Gerais (BR)

( * ) Notice: Subject to any disclaimer, the term of this patent is extended or adjusted under 35 U.S.C. 154(b) by 473 days.

(21) Appl. No.: 09/692,824

(22) Filed: Oct. 19, 2000

(30) Foreign Application Priority Data

May 15, 2000 (BR) ..... 0002020

(51) Int. Cl.
*C22B 1/243* (2006.01)

(52) U.S. Cl. ..... 75/773

(58) Field of Classification Search ..... 75/773
See application file for complete search history.

(56) References Cited

U.S. PATENT DOCUMENTS 5,245,122 A * 9/1993 Smith ..... 588/257
5,476,532 A * 12/1995 Steeghs ..... 75/300
5,897,946 A * 4/1999 Nachtman et al. ..... 428/323

* cited by examiner

*Primary Examiner*—Scott Kastler
(74) *Attorney, Agent, or Firm*—Katten Muchin Rosenman LLP

(57) ABSTRACT

Method to increase the adherence of coating materials on ferrous materials, comprising the step of: before the reduction of iron ores and/or on the agglomerates thereof, contacting same with a dispersion containing at least a particulate material, thus forming a composite coating of at least a material that cannot be substantially hardened in the aqueous mean and at least a material that can be hardened in the aqueous mean.

10 Claims, No Drawings

METHOD TO INCREASE THE ADHERENCE OF COATING MATERIALS ON FERROUS MATERIALS

DISCLOSURE OF THE INVENTION

The present specification is directed to a method to increase the adherence of coating materials on ferrous minerals.

The purpose of this method to increase the adherence is the use of the properties of certain materials to fix more efficiently the coating on ferrous materials in general and on ferrous minerals and/or on iron ores and/or on agglomerates, in order to reduce or even eliminate the sticking or formation of clusters during the reduction of said material(s).

Basically, the method to increase the adherence of coating materials comprises the contact of the iron-containing reducible material with a dispersion of at least a particulate non-pozzolanic material which can be generally referred to as a material that cannot be hardened in the presence of water and at least a particulate pozzolanic material which can be referred to as a material that can be hardened in the presence of water, before all the material is submitted to the reduction step.

As it known by those skilled in the art, the coating or revestiment of ferrous minerals and/or on iron ores and/or on agglomerates thereof for decreasing the sticking during reduction of said material(s) has been widely carried out. However, a certain difficulty in maintaining the coating material adhered to the surface of the material has been detected especially when it undergoes a more intense handling, such as, for example, when the coating is made before the ore is sent to the consumer.

Therefore, one of the objects of the present invention is to provide a method to increase the adherence of coating materials thus eliminating the existing drawbacks in the conventional processes known up to now.

This and other objects and advantages of the present invention are attained by a method to increase the adherence of coating materials made of ore, which method comprises the step of: before the direct reduction of the ore and/or on agglomerates thereof, contacting same with a dispersion containing at least a particulate material, thus forming a composite coating of at least a material that cannot be substantially hardened in the aqueous mean and at least a material that can be hardened in the aqueous mean. With that type of coating, the agent that can be hardened assures that the particles of the material that cannot be hardened adhere to the surface of the material containing iron (ore). Thus, the stability of the coating film can be attained, even when submitted to handling and transporting operations of the coated materials, what can reduce the formation of agglomerates in direct reduction reactors.

Also, in another variant of the operating step, the method to increase the adherence of coating materials of ore in general comprises the step of contacting an iron-containing reducible material with a dispersion containing particulate materials, through dipping, spraying or sprinkling.

The present invention will be described in details as follows and according to non-limiting examples for a better understanding of its inventive concept. Thus, the method to increase the adherence of coating materials on ferrous minerals in general comprises contacting an iron-containing reducible material with a dispersion containing bentonite or any aluminum-containing clay and a material that can be hardened in an aqueous mean, such as a cement. In another embodiment, the method comprises, before the reduction is carried out in iron-making reactors, contacting agglomerates of an iron-containing reducible material with an effective amount of at least a particulate material that can reduce the formation of agglomerates.

By reducing the formation of agglomerates inside the furnaces, a more efficient operation of the direct reduction furnace is assured, besides allowing the operation at more elevated temperatures, thus allowing a greater outflow of material the result of which is a higher productivity of the furnace.

It should be emphasized here that the iron-containing reducible material used in the present invention can be in any form that makes it possible to process same in a direct reduction furnace.

In a non-limiting way, the iron-containing reducible material can be defined by a cold or hot agglomerate, such as pelletized, sintered, bricketed, granulated, and the like. Also it can be in the form of lump ore, granulated ore, fine ore, concentrated ore, and the like.

The dispersion used here consists of a composition or mixture of divided, finely divided and/or crushed solid material, sprayed on a liquid mean. In this text, slurries and suspensions are also regarded as suspensions.

In the method to increase the adherence of coating materials made of ores in general, the particulate material used is of the type that cannot be hardened in an aqueous mean, and therefore a divided, finely divided and/or crushed material capable of forming a dispersion in a liquid mean, besides being substantially inert to the hardening when mixed with water.

Preferably, the particulate material is comprised of an aluminum compound and/or an aluminum-containing source, such as bentonite and bauxite. In a preferred option, an aluminum-containing particulate material based on bauxite and/or aluminum-containing clay is used.

As examples of aluminum-containing clays, bentonite, kaolin ores, bauxite-containing kaolins, bauxite, bauxite- and gibbsite-containing clays, gibbsite, montmorillonites, chlorites, cliaquites, amorphous and variable clays, high-alumina clays such as diaspore clays. It should be stressed that, alternatively, synthetic sodium and aluminum silicates can be advantageously used, and that all particulate materials can be used in either the hydrated or non-hydrated form.

Similarly, in the method to increase the adherence of coating materials made of ore in general, if the particulate material used is of the type that can be hardened in an aqueous mean, it should be a divided, finely divided and/or crushed material capable of forming a dispersion in a liquid mean and can be substantially hardened when mixed to water. Preferably, the particulate material is comprised of cement, such as, in a non-limiting example, Portland cement and pozzolanic cements; also, it is possible to use other types of agents that can be hardened in an aqueous mean without any restriction.

Within this context, the size of the particulate material in the dispersions is determined by its type and ability to form a dispersion in the selected mean. Thus, the average size of the particulate material is in general in the range of between 0.01 micrometer and 500 micrometers, an optimum average size ranging from 0.05 micrometers and 100 micrometers.

The method to increase the adherence of coating materials made of ores in general can use a dispersion containing several materials and/or additives, besides the ones mentioned previously, that are conventionally used to improve the metallurgic properties of the pellet. The non-limiting examples include: olivine, serpentine, magnesium, caustic, coke and the like. Again, the particle size of this material should be within the same range of the particulate materials.

In the accomplishment of the method to increase the adherence of coating materials made of ore in general, several techniques can be used to contact the iron-containing reducible material with the particulate material. Preferably, the processes used involve the formation of a dispersion (slurry, suspension, and the like) of the particulate materials.

Such dispersions, suspensions and/or slurries are formed with the aid of a liquid mean including in a non-limiting example, water, organic solvents, solutions/dispersions of water-soluble polymers, water-dispersible materials (in a non-limiting example, to improve the dispersion or even increase the efficiency of the coating material adhesion).

Thus, the iron-containing reducible material is then contacted with the resultant dispersion, suspension and/or slurry, wherein said contact can be effected, for example, through sprinkling, spraying and/or dipping, and it can also be a partial or complete procedure.

The iron-containing reducible material can also be contacted with a dispersion containing the above mentioned particulate material, at any time before the reduction takes place. In the event the iron-containing reducible material is supplied as pellets, the dispersion can be applied to burnt pellets, in a step between the process for producing same and its use in the reduction reactors.

Thus, the effective amount that causes the reduction in the formation of agglomerates also varies depending on different factors known by those skilled in the art. Amongst such factors, the type of iron-containing reducible material; its physical form; its humidity content; the type of specific particulate material used; its form and other physical characteristics; the dispersion mean, the operating conditions of the direct reduction furnace, and the like, can be mentioned.

Although the effective amount of particulate material that reduces the formation of agglomerates is a non-limiting item, it is typically over 0.01% by weight, based on the dry weight of the iron-containing reducible material, after the contact with the particulate material.

Preferably, the particulate material is present in the range from 0.01% by weight to approximately 2% by weight in relation to the dry base metric ton of material to be coated.

A typical dispersion contains from 1 to 80% by weight of particulate material, the balance being comprised of the dispersion mean, such as water. As a non-limiting example, bauxite and Portland cement are used as particulate materials, in a typical aqueous dispersion within the range of about 10% by weight to about 80% by weight of solid materials in water, and preferably 5% by weight to 40% by weight. The ratio between the material that cannot be hardened in an aqueous mean and the material that can be hardened may range from about 5 to 40%, preferably about 20%, that is, a 1:20 ratio between the agent that can be hardened and agent that cannot be hardened.

Depending on the contact conditions, bauxite and Portland cement are present in the iron-containing reducible material in the range from between 0.01% by weight and 1% by weight.

Non-limiting examples for accomplishing the method are given below, in which:

By using iron ore pellets, the following test was carried out:

reference dispersion in water: % by weight of solids=15% bauxite;

test dispersion in water: % by weight of solids=15% (equivalent to 7.5% bauxite and 7.5% Portland cement);

dispersion applied on the pellets as a spray;

variable: equivalent coating rate (kg of total solids sprayed/metric ton of pellets);

tumbling test after coating, to evaluate the adherence of the coating film according to ISO 3271, part 2 standard;

sticking test according to ISO 11256 standard;

chemical composition of the pellet sample tested:

Fe: 68.0%; $SiO_2$: 1.20%; $Al_2O_3$: 0.50%; CaO: 0.70; Mg: 0.25%.

Results obtained:

| Tests | Coating | INITIAL equivalent coating rate (kg of sprayed solids/metric ton of pellets) | Coating rate AFTER TUMBLING (kg of sprayed solid/metric ton of pellets) | Pellets sticking rate (%) |
|---|---|---|---|---|
| References | No coating | 0.0 | 0.0 | 98.3 |
| | Coated with a dispersion containing water and bauxite | 0.5 | 0.26 | 79.2 |
| | | 1.0 | 0.48 | 63.5 |
| | | 1.5 | 0.79 | 58.7 |
| | | 2.0 | 1.05 | 43.8 |
| Proposed method | Coated with a dispersion containing water and bauxite and Portland cement | 0.5 | 0.46 | 58.4 |
| | | 1.0 | 0.89 | 44.2 |
| | | 1.5 | 1.39 | 13.6 |
| | | 2.0 | 1.88 | 4.2 |

The invention claimed is:

1. A method of operating a direct reduction furnace with a reduction in the formation of agglomerates and increasing the adherence of non-hardenable coating materials on ferrous materials comprising contacting the ferrous material with an aqueous mixture of the non-hardenable coating materials and a material which hardens in the presence of water thereby forming a coating film on the ferrous material surface.

2. The method of claim 1 wherein the material used to harden the coating film is selected from the group consisting of Portland cements, pozzolanic cements, aluminous cements and mixtures thereof.

3. The method of claim 2 wherein the cements have particle size distribution between 0.01 micrometer and 100 micrometers.

4. The method of claim 2 wherein the weight ratio of cement to ferrous material is between 1 to 40 and 1 to 5.

5. The method of claim 1 wherein the non-hardenable material used to coat the ferrous material surface is selected from the group consisting of bentonite clays, bauxite, aluminum containing clay and mixtures thereof.

6. The method of claim 5 wherein the non-hardenable material has particle size distribution between 0.01 micrometer and 500 micrometers.

7. The method of claim 5 wherein the non-hardenable material has particle size distribution between 0.05 micrometer and 100 micrometers.

8. The method of claim 5 wherein the non-hardenable material ranges from 0.01% by weight to approximately 2% by weight in relation to the dry weight of the ferrous material to be coated.

9. The method of claim 1, wherein the ferrous material is pellet, briquette, sized or fine ore.

10. The method of claim 1, wherein the sum of hardenable plus non-hardenable material in the water dispersion ranges from 1 to 80% by weight of the dispersion.

* * * * *